US009616465B1

(12) United States Patent
Strawn et al.

(10) Patent No.: US 9,616,465 B1
(45) Date of Patent: Apr. 11, 2017

(54) DRY TRIM AND SIFT BAG APPARATUS AND METHOD OF USE

(71) Applicants: Kenneth B. Strawn, Oroville, CA (US); Benjamin E. McCord, Chico, CA (US)

(72) Inventors: Kenneth B. Strawn, Oroville, CA (US); Benjamin E. McCord, Chico, CA (US)

( * ) Notice: Subject to any disclaimer, the term of this patent is extended or adjusted under 35 U.S.C. 154(b) by 84 days.

(21) Appl. No.: 14/810,634

(22) Filed: Jul. 28, 2015

(51) Int. Cl.
*B07B 1/46* (2006.01)
*B07B 1/02* (2006.01)

(52) U.S. Cl.
CPC . *B07B 1/02* (2013.01); *B07B 1/46* (2013.01)

(58) Field of Classification Search
CPC ..... B07B 1/02; B07B 1/06; B07B 1/46; B65F 1/1405
USPC ..... 209/412, 414; 220/9.2
See application file for complete search history.

(56) References Cited

U.S. PATENT DOCUMENTS 400,588 A * 4/1889 Meyering ..... A01K 97/05 119/65
1,105,327 A * 7/1914 Hodges ..... B07B 1/005 209/259
2,837,860 A * 6/1958 Norling ..... A01K 97/05 220/9.2
3,608,838 A 9/1971 Lundin et al.
4,162,967 A * 7/1979 Gironda, Jr. ..... B07B 1/02 209/235
5,325,971 A * 7/1994 Moran ..... B07B 1/02 209/235
5,960,983 A * 10/1999 Chan ..... B65F 1/02 220/489
6,612,453 B2 * 9/2003 Joo-Tai ..... D06F 95/002 220/9.2
7,815,372 B2 10/2010 Stanton et al.
7,946,764 B2 5/2011 Sulpizio et al.
8,511,895 B2 * 8/2013 Burchfield ..... B65F 1/0006 248/99
8,757,524 B2 6/2014 Mosman
9,027,758 B2 * 5/2015 Lee ..... A47J 43/22 209/233
9,289,800 B1 * 3/2016 Rosado ..... A01B 1/08
9,409,666 B1 * 8/2016 Staten ..... B65B 67/04
9,469,474 B2 * 10/2016 Austin ..... B65F 1/004
2005/0284866 A1 12/2005 Oakner et al.
2007/0069056 A1 3/2007 Shouse et al.
2014/0196587 A1 7/2014 Beyerlein et al.
2014/0374332 A1 * 12/2014 Hannah ..... E03F 5/0404 210/170.03

(Continued)

*Primary Examiner* — Joseph C Rodriguez

(57) ABSTRACT

A dry trim and sift bag apparatus comprising a hollow body having open axial ends; a pair of selectively openable and closable end caps respectively sealing the open axial ends; a compression spring operatively coupled to the hollow body and configured to hold the hollow body in an expanded configuration and to be collapsed under compression to a collapsed configuration; and a sifting screen operatively coupled within the hollow body partitioning the interior of the hollow body into a trim chamber for product to be trimmed and a sift chamber for sifted product, the trim chamber having a greater volume than the sift chamber. Additionally, the dry trim and sift bag apparatus comprises multiple handle assemblies for ergonomic and efficient motion series of operation.

7 Claims, 20 Drawing Sheets

(56) References Cited

U.S. PATENT DOCUMENTS

2015/0314956 A1* 11/2015 Clevenger ..... B65F 1/1405
220/9.2

* cited by examiner

DRY TRIM AND SIFT BAG APPARATUS AND METHOD OF USE

FIELD OF THE INVENTION

This invention relates generally to trimmers for plant materials and particularly to a dry trim and sift bag apparatus and method of use for same and, more particularly, to a collapsible multi chamber screen partitioned dry trim and sift bag apparatus and method of use for same.

BACKGROUND OF THE INVENTION

As is known in the art, a *cannabis* or marijuana plant comprises several structures, many of which are common with ordinary flowering species. Where *cannabis* plants start to differentiate is in its flowers where unique and intricate formations occur. The flower or calyx comprises multiple buds and, as the calyx grows, leaf and the phyllary of the flower structure extend from the buds.

Most if not all authorized dispensaries of medical marijuana, as well as their patients, prefer to purchase only those buds that have been separated from the main stalk and stems and that have been methodically trimmed for removing the leaf and phyllary of the flowers.

Accordingly, authorized growers incur the time consuming and laborious task of trimming the buds thereby increasing the cost of the product. This increase in cost is passed onto the dispensaries, which in turn, pass the increase in cost onto the patients.

Varieties of other flowering species also require the time consuming and laborious task of trimming prior to sale. For example, roses require the trimming of generally loose petals and/or thorns.

Hence, there is a need to overcome the significant shortcomings of the known prior-art as delineated hereinabove.

BRIEF SUMMARY OF THE INVENTION

Accordingly, and in one aspect, an embodiment of the invention ameliorates or overcomes one or more of the shortcomings of the known prior art by providing a dry trim and sift bag apparatus comprising a hollow body having open axial ends; a pair of selectively openable and closable end caps respectively sealing the open axial ends, a compression spring operatively coupled to the hollow body and configured to hold the hollow body in an expanded configuration and to be collapsed under compression to a collapsed configuration; and a sifting screen operatively coupled within the hollow body and partitioning the interior of the hollow body into a trim chamber for product to be trimmed and a sift chamber for sifted product, the trim chamber having a greater volume than the sift chamber. Additionally, the dry trim and sift bag apparatus comprises multiple handle assemblies for ergonomic and efficient motion series of operation.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
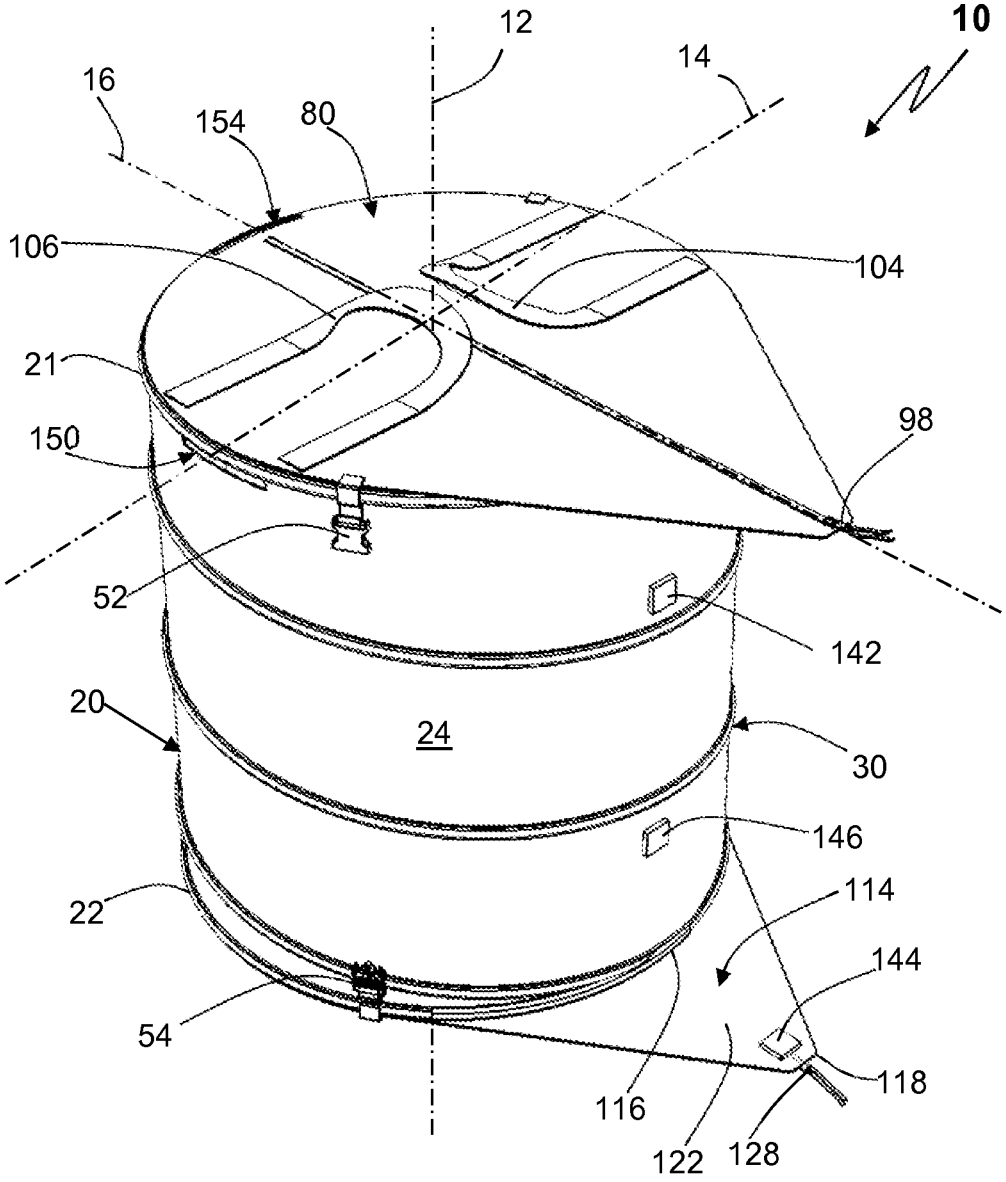
FIG. 1 is a first axial end perspective view of an embodiment of a dry trim and sift bag apparatus in an expanded configuration.

Considering the drawings, wherein like reference numerals denote like parts throughout the various drawings figures, reference numeral 10 is directed to an embodiment of a dry trim and sift bag apparatus and, in particular, to a collapsible multi chamber screen partitioned dry trim and sift bag apparatus.

Axis 12, 14, and 16

Referring to FIG. 1, a set of three mutually perpendicular or orthogonal coordinate axes is defined for the dry trim and sift bag apparatus 10 as comprising a longitudinal axis 12, a transverse or lateral axis 14, and a perpendicular or vertical axis 16.

Sidewall 20

Figure 2:
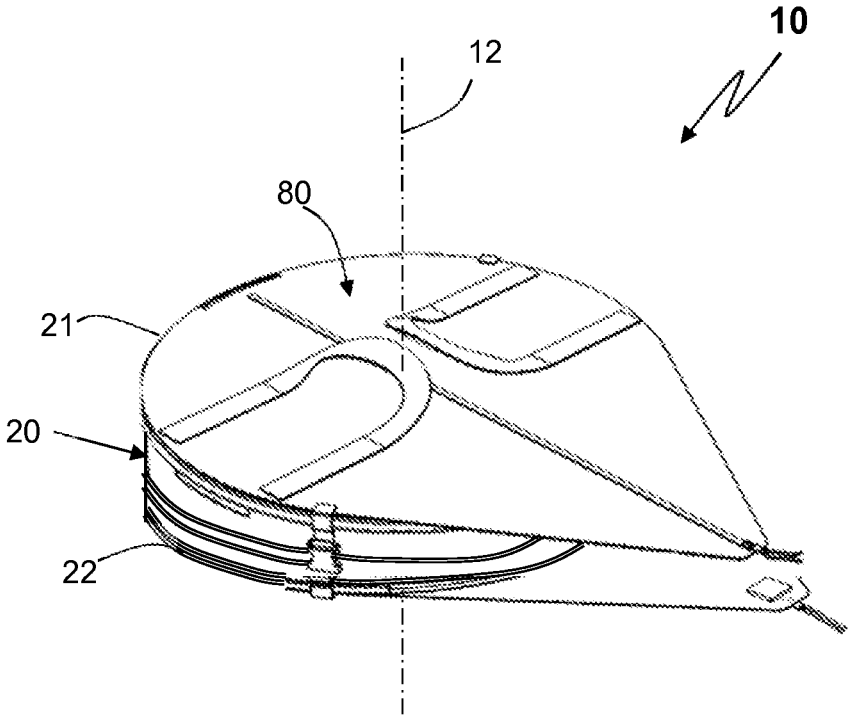
FIG. 2 is a perspective view of an embodiment of the dry trim and sift bag apparatus in an collapsed configuration.

Referring to FIGS. 1 and 2 and in one embodiment, the dry trim and sift bag apparatus 10 comprises a flexible circumscribing sidewall 20 defining a hollow body configured to be repeatedly opened and closed along the central longitudinal axis 12 between an expanded configuration illustrated in FIG. 1 and a collapsed configuration as illustrated in FIG. 2.

Sidewall 20 comprises, but is not limited to, a generally cylindrical shape that extends between a first annular peripheral end 21 and a second annular peripheral end 22 generally parallel with and spaced from the first annular peripheral end 21 along the central longitudinal axis 12. Sidewall 20 also comprises a circumscribing exterior surface 24.

Figure 3:
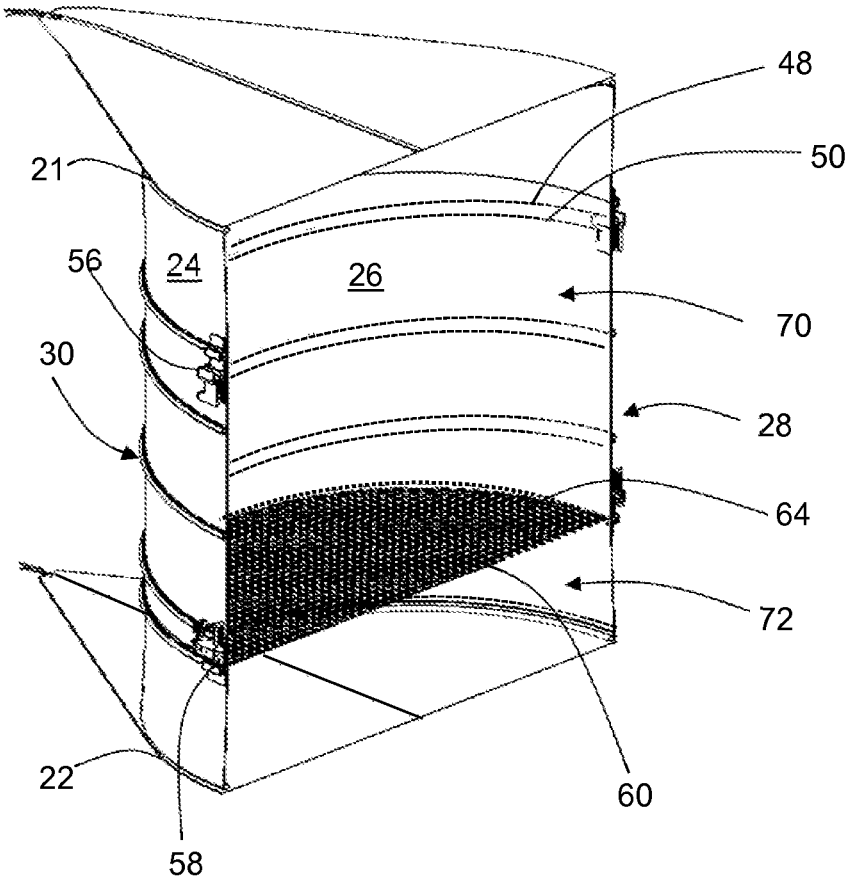
FIG. 3 is a vertical sectional view of an embodiment of the dry trim and sift bag apparatus.
Figure 4:
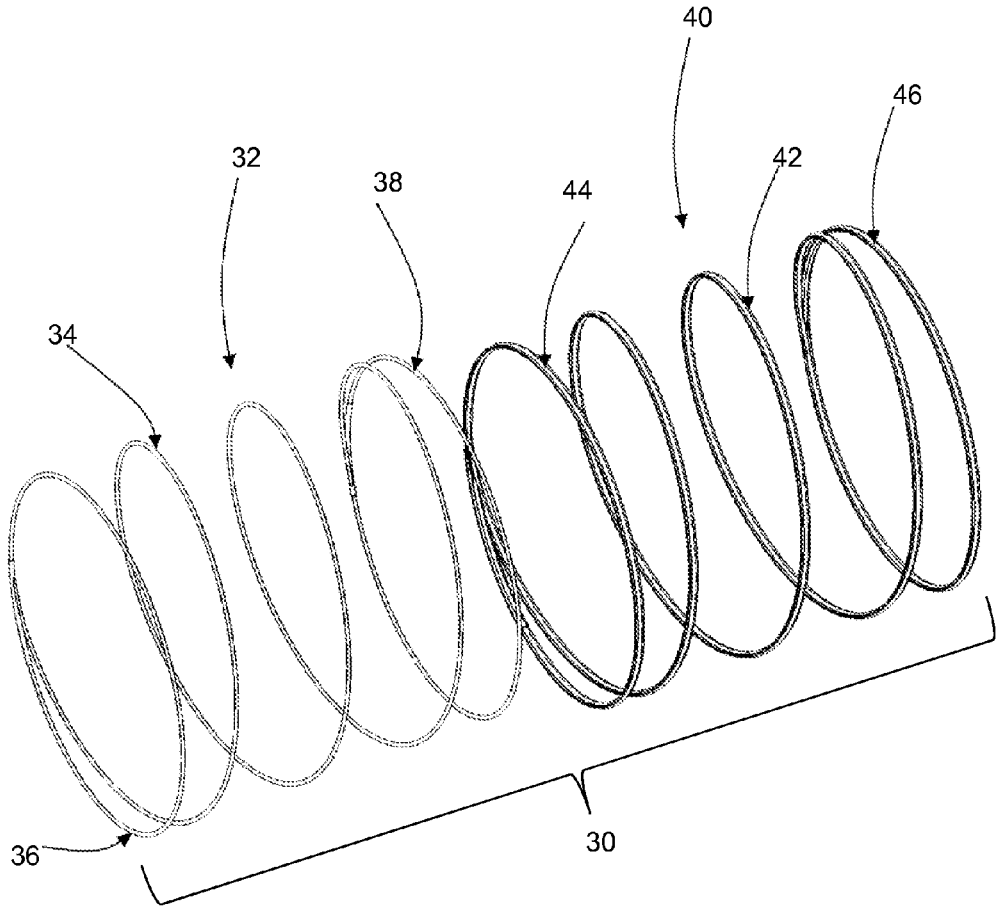
FIG. 4 is an exploded parts perspective view of an embodiment of a coil spring and hem assembly of the dry trim and sift bag apparatus.

Referring to FIG. 3, sidewall 20 further comprises a circumscribing interior frictional surface 26 that defines an open-ended axial or longitudinal bore or chamber 28 extending between respective first and second open peripheral ends 21, 22.

Sidewall Material

In one embodiment, the flexible circumscribing trim and sift bag sidewall 20 is formed of, but not limited to about a two-hundred denier (200) to about four-hundred-twenty (420) denier nylon or polyester fabric, or an equivalent functioning material thereof. This material provides the necessary interior cylindrical frictional surface 26 with a coefficient of friction that provides an efficient trimming surface for the apparatus 10 while reducing excessive dust during use.

The flexible material configuration of side wall 20 further allows apparatus 10 to be repeatedly opened and closed between the expanded configuration and the collapsed configuration along the central longitudinal axis 12 without causing substantial wear or other deleterious effects on apparatus 10.

Coil Spring and Hem Assembly 30

As illustrated in FIG. 1, the dry trim and sift bag apparatus 10 further comprises a coil spring and hem assembly 30 operatively coupled to sidewall 20 for providing means for forcing or urging the flexible circumscribing trim bag sidewall 20 from the collapsed configuration state into the expanded configuration state. The expanded configuration of the flexible circumscribing trim bag sidewall 20 is maintained by coil spring and hem assembly 30 until a subsequent compressive force is applied thereto. The coil spring and hem assembly 30 can be operatively coupled on the interior surface 26 or exterior surface 24 of sidewall 20 by, but not limited to, stitching.

Referring to FIGS. 1 through 4, an embodiment of the coil spring and hem assembly 30 comprises a coil spring 32 and a hem 40 covering or enveloping the coil spring 32. Generally parallel flanking stitching or stitch lines 48 and 50 (FIG. 3) secure the hem 40 to the sidewall 20 with the coil spring 32 interposed between hem 40 and sidewall 20. In one embodiment, the coil spring 32 is interposed between the hem 40 and the exterior surface 24 of sidewall 20. In another embodiment, coil spring 32 can be interposed between the hem 40 and the interior surface 26 of sidewall 20.

Coil Spring 32

Still referring to FIGS. 1 through 4, an embodiment of the coil spring 32 comprises a coil or spiral spring medial portion 34 (Ha 4) that extends along the exterior surface 24 of the sidewall 20 between a first spring end loop 36 disposed adjacent to and circumscribing the first peripheral end 21 of sidewall 20 and a second spring end loop 38 disposed adjacent to and circumscribing the second peripheral end 22.

Spring Hem 40

The spring hem 40 is generally complemental in shape to the coil spring 32 and comprises a medial hem portion 42 (FIG. 4) attached to and extending between a first hem loop end portion 44 and a second hem loop end portion 46. Medial spring hem portion 42 covers or envelopes the spiral spring medial portion 34 of coil spring 32 while the first and second hem loop end portions 44, 46 cover or envelope the first and second spring end loops 36, 38 respectively.

Continuing to refer to FIGS. 1 through 4, a first series of stitches 48 (FIG. 3) is stitched through the spring hem 40 and sidewall 20 parallel to and just above the coil or spiral spring medial portion 34 and the first and second spring end lops 36, 38. Similarly, a second series of stitches 50 is stitched through the spring hem 40 and sidewall 20 parallel to and just below the coil or spiral spring medial portion 34 and the first and second spring end lops 36, 38.

Accordingly, hem 40 captures the respective spring portions between the respective hem portions and the respective exterior surface 2, 4 of the flexible circumscribing sidewall 20. In particular, the first and second series of stitches or stitch lines 48, 50 attaches the spiral medial portion 34 of the coil spring 32 to the exterior surface 24 of sidewall 20, the first spring end loop 36 adjacent first open peripheral end 21 and the second spring end loop 38 adjacent second open peripheral end 22.

By attaching the coil spring 32 to the exterior surface 24 of sidewall 20 a generally uninterrupted coefficient of friction is maintained substantially along the interior surface 26 defining the chamber 28 of sidewall 20.

Other techniques may be used for securing the hem 40 to flexible circumscribing trim bag sidewall 20 as a person of ordinary skill in the art will recognize as now informed by the instant disclosure.

For example the coil spring 32 may be secured to sidewall 20 by, for example, a plurality of loops formed of fabric, plastic, metal or some other suitable material positioned at spaced locations along the length of the coil spring 32 to join coil spring 32 to sidewall 20.

Compression of the coil spring 32 collapses the flexible circumscribing trim bag sidewall 20 to the collapsed or transport state (FIG. 3) and the release of compression of the coil spring 32 allows expansion of sidewall 20 between the collapsed or transport state and the expanded or use state.

Coil Spring Material

In one embodiment cod spring 32 is formed from, but not limited to, hardened steel. Other suitable materials such as plastics can be employed for fabrication.

Mating Clasps Member Pairs 52, 54 and 56, 58

The dry trim and sift bag apparatus 10 further comprises means for holding the coil spring 32 in the compression state (FIG. 2) in the form of, but not limited to, mating clasps member pairs 52, 54 (FIG. 1) and 56, 58 (FIG. The mating clasps member pairs 52, 54 and 56, 58 are spaced apart along axis 12 and attached to the coil spring and hem assembly 30 adjacent the exterior surface 26 of the sidewall 20 with about one degrees of separation between the first set of mating pairs 52, 54 and the second set of mating pairs 56, 58.

When the spring is compressed and the mating clasps member pairs 52, 54 and 56, 58 are respectively coupled, the coil spring 32 is maintained in a collapsed configuration. When the mating clasps member pairs 52, 54 and 56, 58 are uncoupled, the coil spring 32 transitions into its normal expanded configuration from its collapsed configuration.

Screen 60

Figure 5:
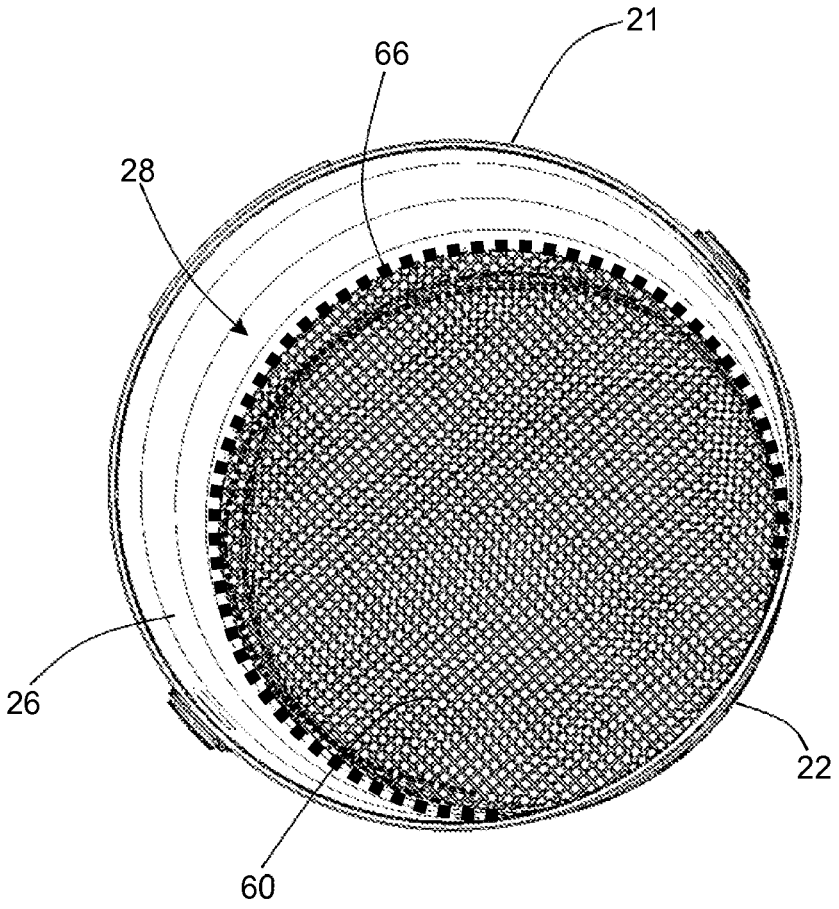
FIG. 5 is a top perspective view of an embodiment of the dry trim and sift bag apparatus in an expanded configuration and with axial end caps removed therefrom.

Referring to FIGS. 3 and 5, dry trim and sift bag apparatus 10 further comprises a sieve or screen insert 60 having a diameter dimensioned smaller than the interior diameter dimension of the sidewall 20 for allowing insert 60 to be disposed within the interior chamber 28 in a plane generally perpendicular to longitudinal axis 12. As illustrated, the screen insert 60 is disposed within the interior chamber 28 at a location more proximate to the second peripheral end 22 than the first peripheral end 21.

Additionally, the sieve or screen insert 60 secures or removably attaches to the interior frictional surface 26 of the sidewall 20 and/or to the coil spring 32 by way of, but not limited, circumferential stitching 64 (FIG. 3) or circumferential zipper 66 (FIG. 5).

Accordingly, and referring to FIG. 3, sieve or screen insert 60 longitudinally partitions the longitudinal chamber 28 into two distinct chambers comprised of a product trim chamber 70 and a product sift chamber 72 with the screen insert 60 interposed therebetween for providing means for separating relatively larger from smaller or coarser from finer product parts. In one embodiment, the product trim chamber 70 is of greater volume than the volume of the sift chamber 72.

Sieve or screen insert 60 takes the form of, but is not limited to, a perforated circular member comprising an outer periphery operatively coupled to the interior frictional surface 26 of the flexible circumscribing sidewall 20 by way of, but not limited to, circumferential stitching 64 or circumferential zipper 66 as noted above and as illustrated in FIGS. 3 and 5 respectively.

In one aspect, the sieve or screen insert 60 is provided with perforations of about, but not limited to, one-quarter inch (¼ inch) in diameter.

In further aspects, the sieve or screen insert 60 is provided with perforations of about, but not limited to, three-eighths inch (⅜ inch) in diameter or one-half inch (½ inch) in diameter.

In yet further aspects, the sieve or screen insert 60 has perforations of greater than one-half inch (½ inch) in diameter while maintaining a matrix of openings.

The screen insert 60 can also comprise a combination of perforations having different diameters.

Screen Material

Screen insert 60 is formed from, but is not limited to, a matrix of plastic or metal wire, a perforated metal or plastic plate, or perforated fabric.

Teardrop Shaped End Caps 80 and 110

Figure 6:
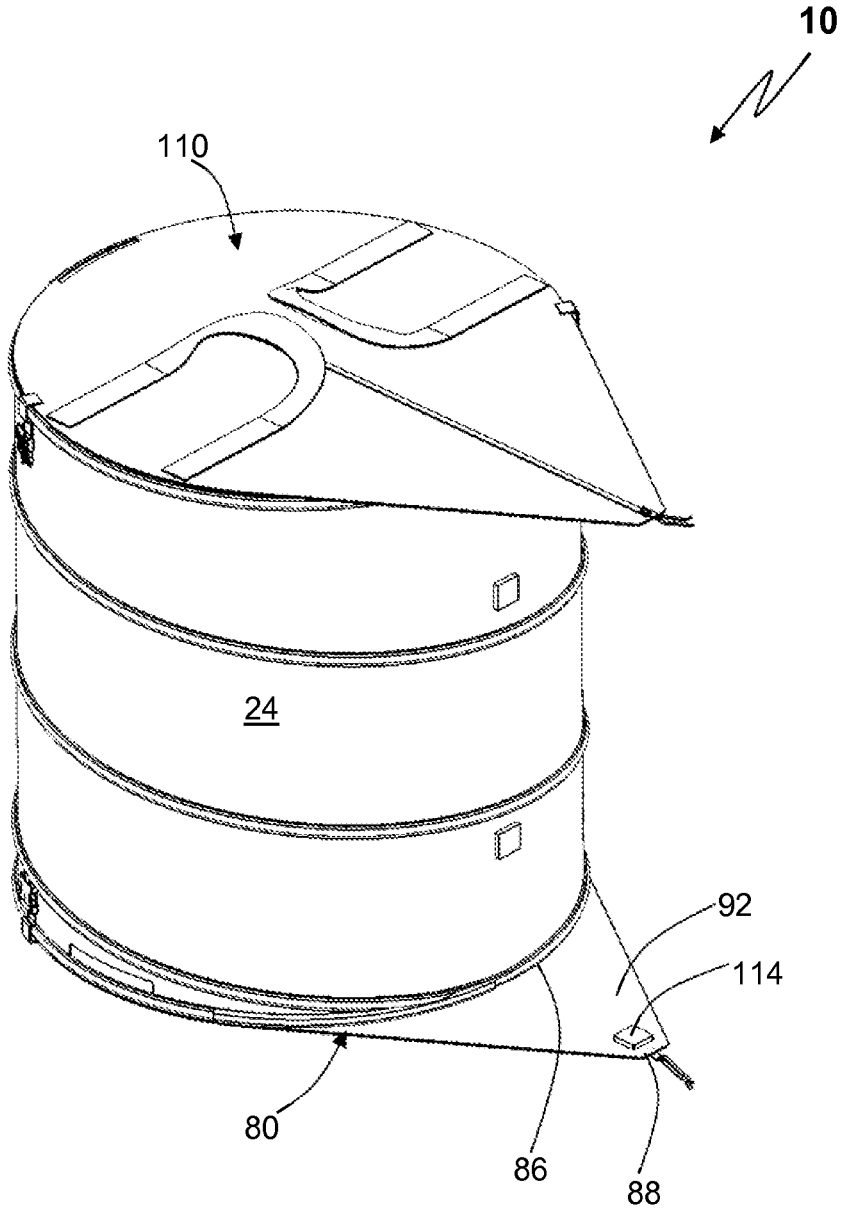
FIG. 6 is a second axial end perspective view of an embodiment of the dry trim and sift bag apparatus in an expanded configuration.

Now referring to FIGS. 1 and 6, the dry trim and sift bag apparatus 10 further comprises a first axial end cap 80 and a second axial end cap 110 each having means for selectively opening and closing the axial end caps 80 and 110 for providing or restricting access to trim chamber 70 and collection chamber 72 respectively. In one embodiment, axial end caps 80 and 110 are generally teardrop in shape.

Teardrop Shaped End Cap 80

Figure 7:
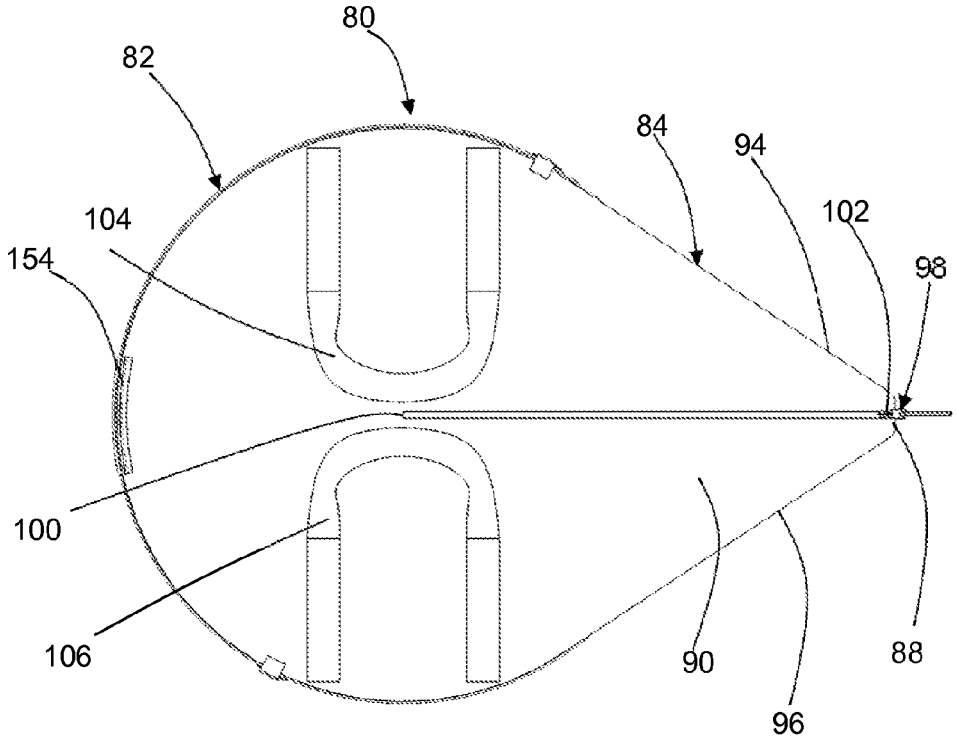
FIG. 7 is a first axial end plan view of an embodiment of the dry trim and sift bag apparatus.

FIG. 7 illustrates a plan view of the teardrop shaped axial end cap 80 comprising a generally circular portion 82 and a funnel or cone-like member 84 radially extending and tapering from an outer peripheral sector portion of the generally circular portion 82 and terminating to a funnel terminus 88.

In one embodiment, the funnel or cone-like member 84 comprises a first triangularly shaped wall 90 having a base defined by an outer peripheral sector portion of the generally circular portion 82.

The funnel or cone-like member 84 further comprises a second triangularly shaped wall 92 (FIG. 6) radially extending from an outer peripheral sector portion 86 and overlapped by the first triangularly shaped wall 90.

The overlapping first and second triangularly shaped walls 90 and 92 are attached at outer peripheral side edges 94 and 96 and at common end or terminus 88 via, for example, stitching for forming the funnel or cone-like member 84 having a base opening in open communication with trim chamber 70 (FIG. 3).

Still referring to FIG. 7, and in one embodiment, a first zipper 98 medially bisects axial end cap 80 and extends from a first end 100 disposed proximate the outer periphery of sidewall 20 to a diametrically opposed second end 102 proximate the terminus 88 wherein the first zipper selectively opens from the second end 102 proximate terminus 88 to first end 100 proximate the outer periphery of sidewall 20.

Teardrop Shaped End Cap 110

Figure 8:
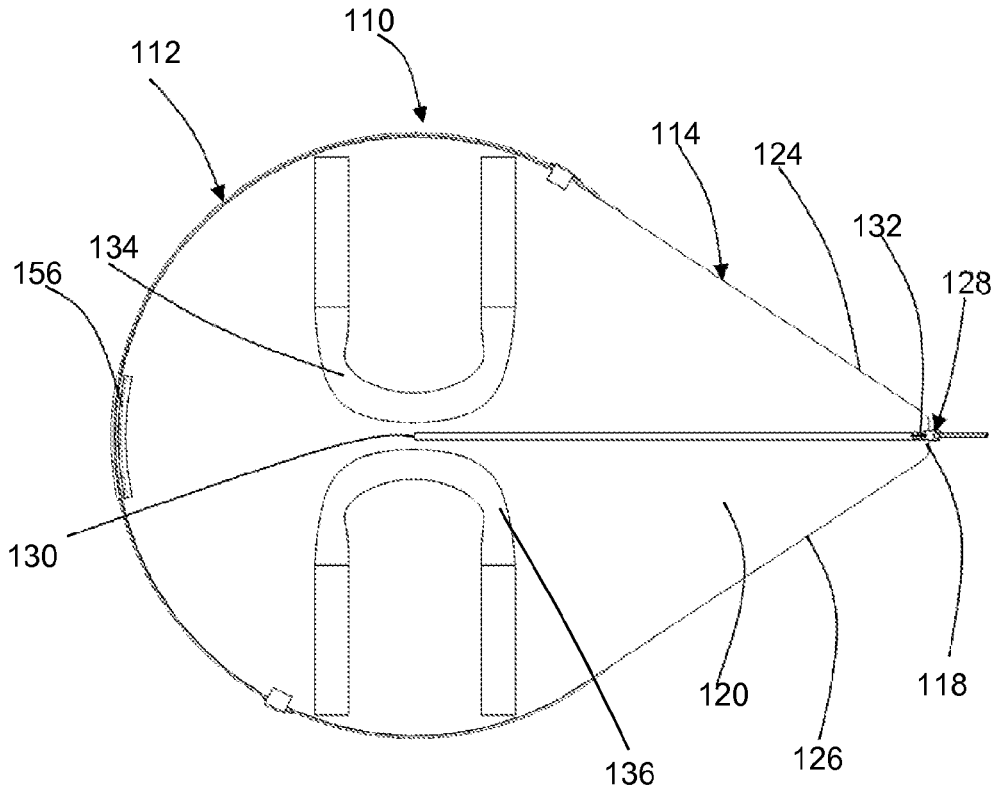
FIG. 8 is a second axial end plan view of an embodiment of the dry trim and sift bag apparatus.

FIG. 8 illustrates a plan view of the teardrop shaped axial end cap 110 comprising a generally circular portion 112 and a funnel or cone-like member 114 radially extending and tapering from an outer peripheral sector portion of the generally circular portion 112 and terminating to a funnel terminus 118.

In one embodiment, the funnel or cone-like member 114 comprises a first triangularly shaped wall 120 having a base defined by the outer peripheral sector portion of the generally circular portion 112. The funnel or cone-like member 114 further comprises a second triangularly shaped wall 122 (FIG. 1) radially extending from an outer peripheral sector portion 116 and overlapped by the first triangularly shaped wall 120.

The overlapping first and second triangularly shaped walls 120 and 122 of end cap 110 are attached at outer peripheral side edges 124 and 126 and at the common end or terminus 118 via, for example, stitching for forming the funnel or cone-like member 114 having a base opening in open communication with sill chamber 72 (FIG. 3).

Still referring to FIG. 8 and in one embodiment, second zipper 128 medially bisects axial end cap 110 and extends from a first end 130 disposed proximate the peripheral end 22 of sidewall 20 to a diametrically opposed second end 132 proximate the terminus 118 wherein the second zipper 128 selectively opens from the second end 132 proximate terminus 118 to the first end 130 proximate peripheral end 22 of sidewall 20.

Operation of End Caps 80 and 110

In one embodiment, the teardrop shaped axial end caps 80 and 110 serve to enclose product during motions and funnel trimmed and waste product during unloading by way of about 10-12 inches of overlapping material that extend past the coil spring 32 on both end caps 80 and 110 that form the funnel or cone-like members 84 and 114.

As noted above, an embodiment of the teardrop shaped axial end caps 80 and 110 respectively seal with zippers 98 and 128 but are not limited thereto and other applicable selectively opening and closing means such as a hook and loop means or button means may be employed.

Partially opening the end-cap 80 is obtained by partially opening the zipper 98 for creating a funnel to guide product out of apparatus 10 for easy unloading. Likewise, partially opening the end-cap 110 is obtained by partially opening zipper 128 for creating a funnel to guide product out of sift chamber 72 for easy unloading.

Magnetic Snap Pairs 140, 142 and 144, 146

Figure 9:
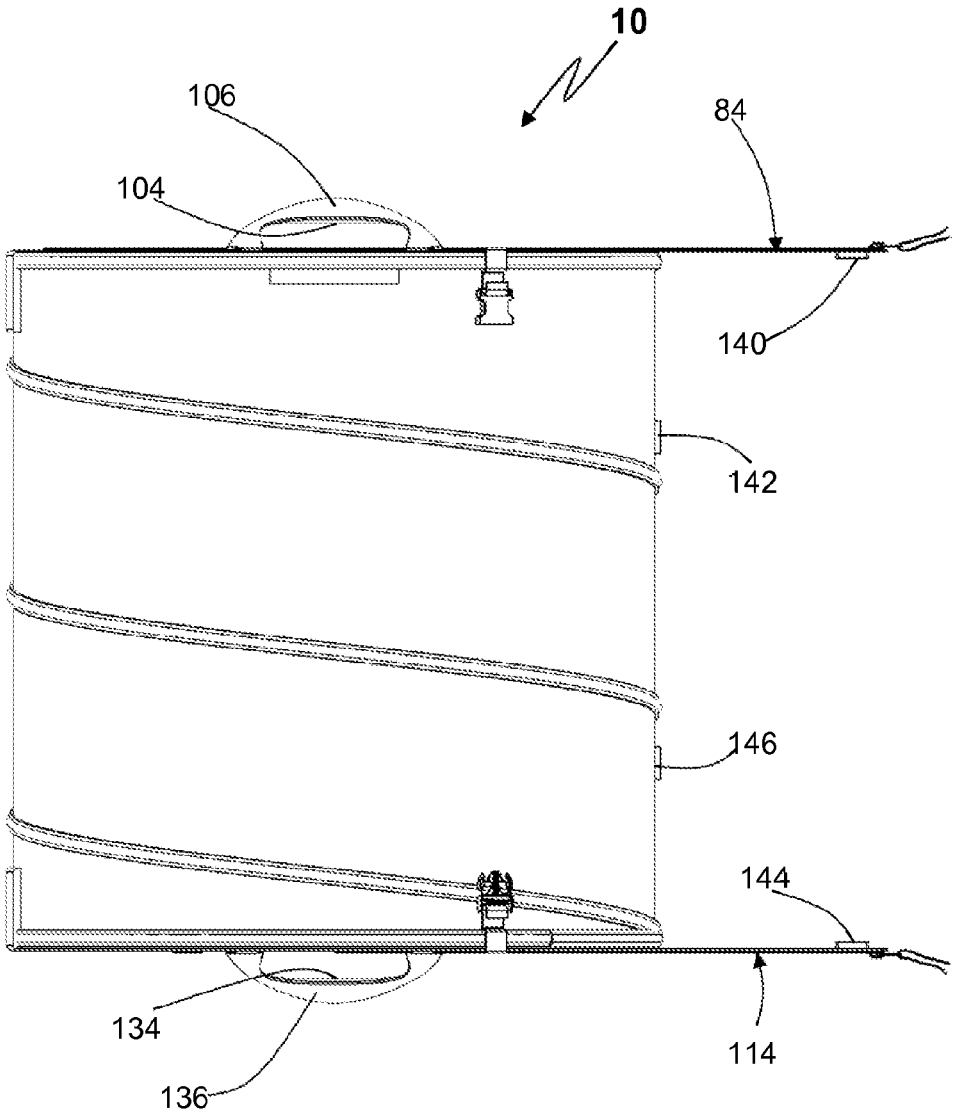
FIG. 9 is a side elevation view of an embodiment of the dry trim and sift bag apparatus with a funnel or cone-like members decoupled from a sidewall.
Figure 10:
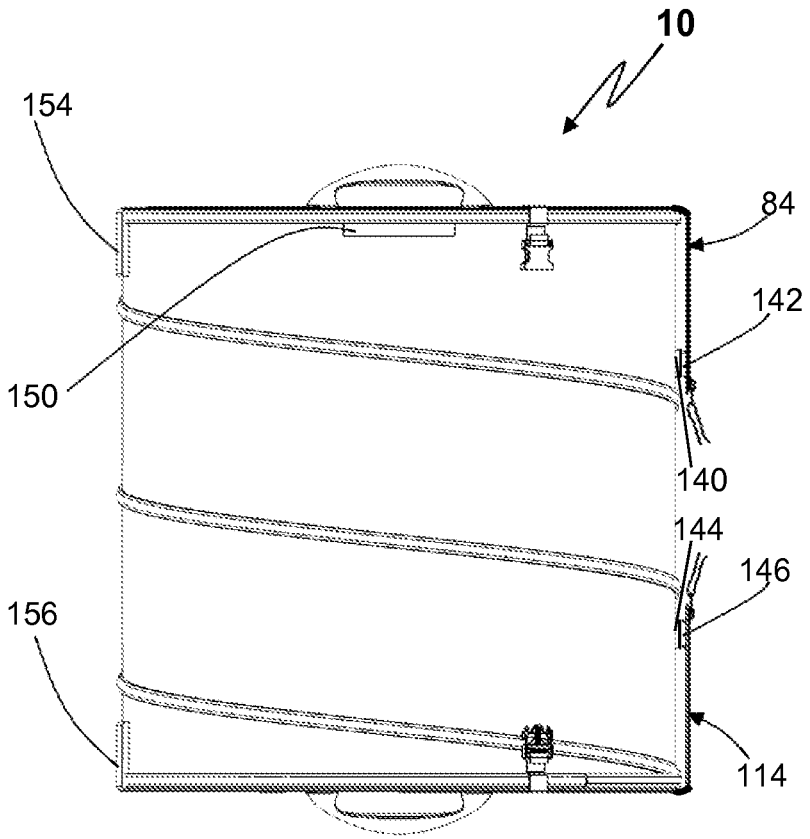
FIG. 10 is a side elevation view of an embodiment of the dry trim and sift bag apparatus with the funnel or cone-like members coupled to the sidewall.

Referring to FIGS. 9 and 10, dry trim and sift bag apparatus 10 further comprises magnetic snap pairs 140, 142 and 144, 146 or equivalent. During a motion series detailed below, the funnel or cone-like members 84 and 114 secure in place using respective magnetic snap pairs 140, 142 and 144, 146 as illustrated in FIG. 10.

Axial Strap Handle Pairs 104, 106 and 134, 136

Referring to FIGS. 7 and 8, the dry trim and sift bag apparatus 10 further comprises a first pair of spaced apart and diametrically opposed U-shaped strap handles 104, 106 (FIG. 7) attached by, but not limited to, stitching to the exterior surface of the generally circular portion 82 of the axial end cap 80.

Similarly, dry trim and sift bag apparatus 10 further comprises a second pair of spaced apart and diametrically opposed U-shaped strap handles 134, 136 (FIG. 8) attached by, but not limited to, stitching to the exterior surface of the generally circular portion 112 of the axial end cap 110.

As illustrated in FIG. 9, the diametrically opposed strap handles 104 and 106 are spaced apart and dimensioned so that a user can bring the two together and hold in one hand. Likewise, the diametrically opposed strap handles 134 and 136 are spaced apart and dimensioned so that the user can bring the two together and hold in the other hand. This allows the user to retain possession and control during use and operation delineated below.

Hand Pockets 150, 152

Figure 11:
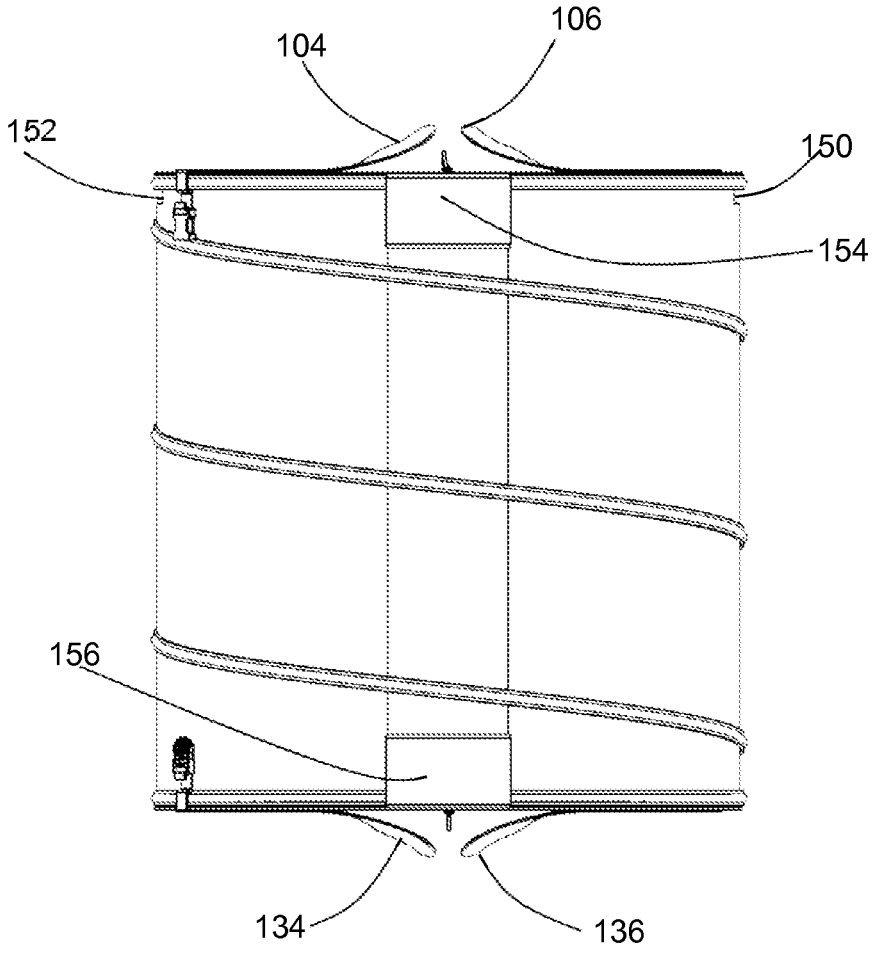
FIG. 11 is a back elevation view of an embodiment of the dry trim and sift bag apparatus.

Referring to FIGS. 1 and 11, an embodiment of the dry trim and sift bag apparatus 10 further comprises a diametrically opposed pair of hand pockets 150, 152 formed within the sidewall at a location proximate to the peripheral end 21 and below axial end cap 80.

In use and operation, the diametrically opposed pair of hand pockets 150, 152 provides means for holing apparatus 10 proximate axial end cap 80 to retain possession and control of apparatus 10 during use and operation delineated below.

Sidewall Handles 154, 156

Referring to FIGS. 1 and 11, an embodiment of the dry trim and sift bag apparatus 10 further comprises a pair of axially spaced apart (spaced along axis 12) sidewall handles 154, 156 attached to the sidewall 20 proximate to the peripheral ends 21, 22 respectively. In use and operation, the axially spaced apart sidewall handles 154, 156 provide means for holing apparatus 10 in a generally horizontal manner to retain possession and control of apparatus 10 during use and operation delineated below.

Acute Angel Sieve or Screen Insert 60

Figure 12:
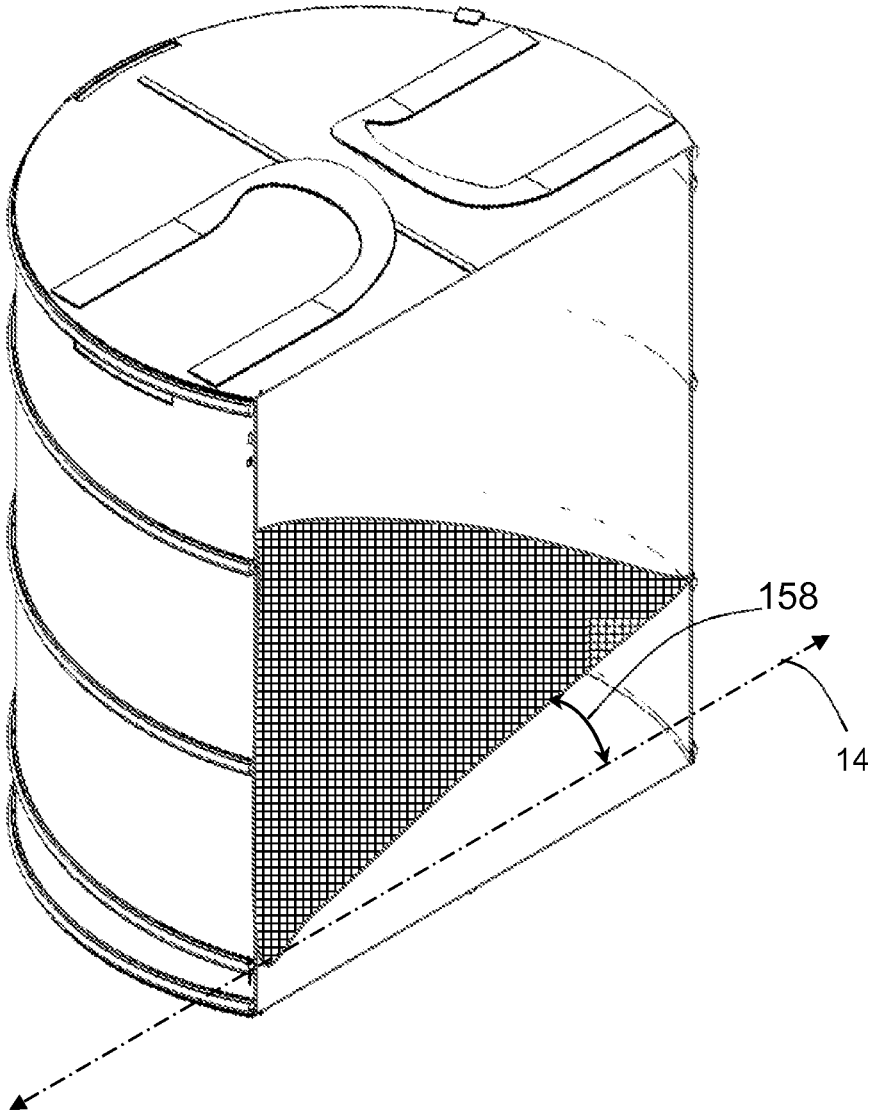
FIG. 12 is a vertical sectional view of an embodiment of the dry trim and sift bag apparatus having a sieve or screen partition disposed at an acute angle relative to a lateral axis.

As illustrated in FIG. 12, the sieve or screen insert 60 is alternatively disposed within the interior chamber 28 at an acute angle 160 relative to the second open peripheral end 22 or, in other words, in a plane located at an acute angle 158 relative to the plane formed by the lateral and perpendicular axis 14 and 16 respectively.

Alternate Embodiment 210

Figure 13:
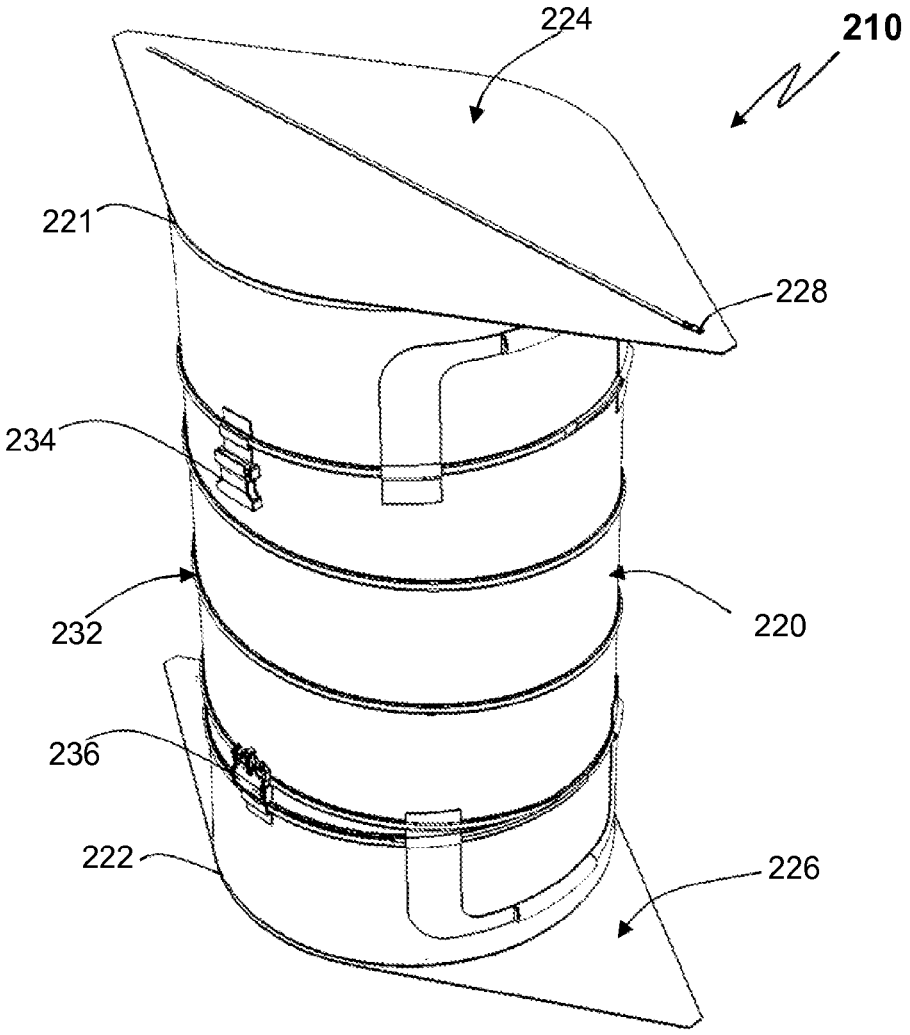
FIG. 13 is a first axial end perspective view of an alternative embodiment of a dry trim and sift bag apparatus in an expanded configuration.
Figure 14:
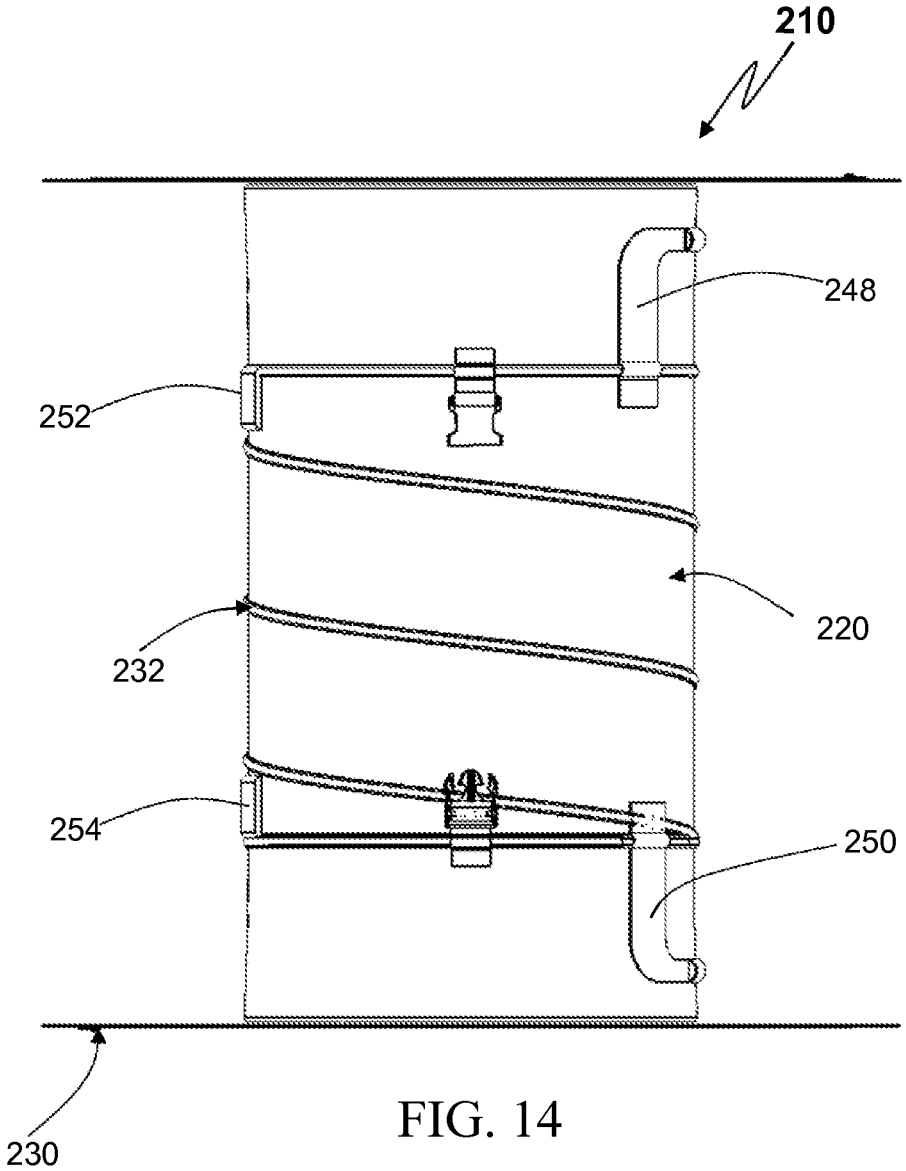
FIG. 14 is a side elevation view of the alternative embodiment to the dry trim and sift bag apparatus illustrated in FIG. 13.
Figure 15:
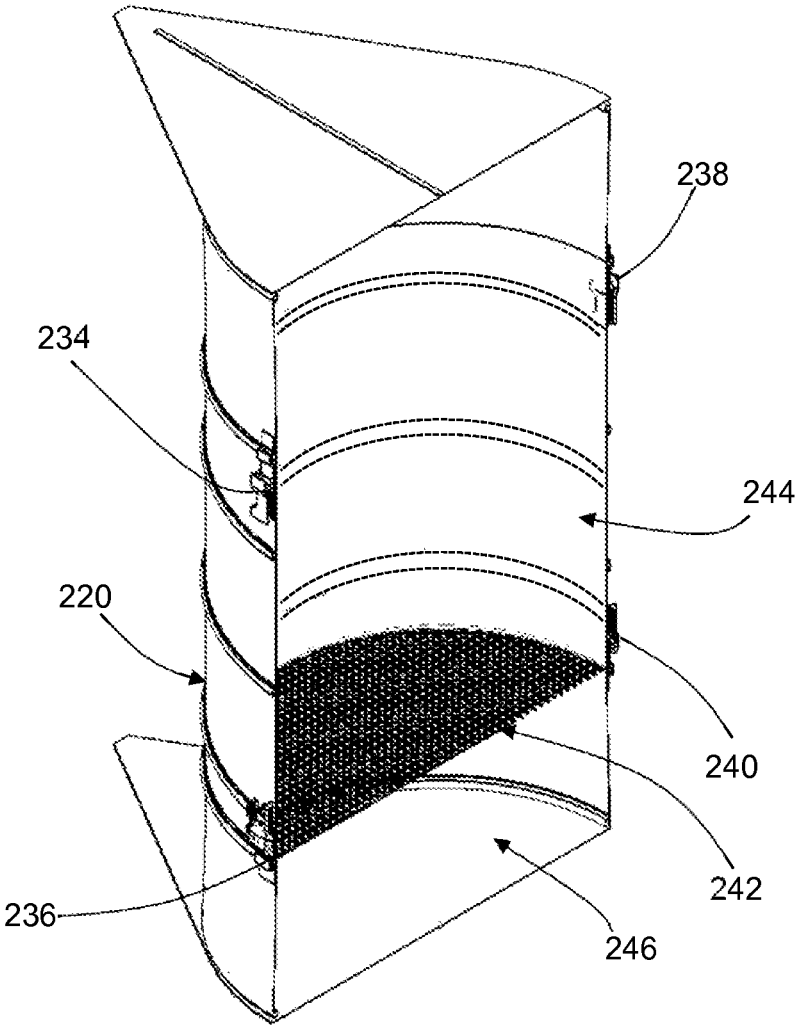
FIG. 15 is a vertical sectional view of the alternative embodiment of the dry trim and sift bag apparatus illustrated in FIG. 13.

Referring to FIGS. 13 through 15, reference numeral 210 is directed to another embodiment of a collapsible multi chamber screen partitioned dry trim and sift bag apparatus.

Analogous to apparatus 10, the collapsible multi chamber screen partitioned dry trim and sift bag apparatus 210 comprises a hollow body 220 having open axial ends 221 and 222 selectively openable and closeable by way of an attached a pair of selectively openable and closable end caps 224 and 226 respectively sealing the open axial ends 221 and 222. Each of selectively openable and closable end cap 224 and 226 has a back to back teardrop shape with a medially disposed zipper 228 and 230 respectively.

Also analogous to apparatus 10, the dry trim and sift bag apparatus 210 comprises a compression coil spring and hem assembly 232 operatively coupled to the hollow body 220 and configured to hold the hollow body 220 in an expanded configuration and to be collapsed under compression to a collapsed configuration held by the coupling of mating clasps member pairs 234, 236 and 238, 240 attached to the outer coil loops of the compression coil spring and hem assembly 232.

Furthermore, and analogous to apparatus 10, the dry trim and sift bag apparatus 210 comprises a sifting screen 242 operatively coupled within the hollow body 220 and partitioning the interior of the hollow body into a trim chamber 244 for product to be trimmed and a sift chamber 246 for sifted product, the trim chamber 244 having a greater volume than the sift chamber 246.

Moreover, the dry trim and sift bag apparatus 210 comprises multiple handle assemblies for ergonomic and efficient motion series of operation. In particular, apparatus 210 comprises a pair of axially spaced apart U-shaped strap handles 248 and 250 attached to the outer coil loops of the compression coil spring and hem assembly 232. In addition, apparatus 210 comprises a pair of axially spaced apart sidewall handles 252 and 254 also attached to the outer coil loops of the compression coil spring and hem assembly 232 at a location of about one-hundred-eighty degrees from the pair of axially spaced apart U-shaped strap handles 248 and 250.

Alternate Embodiment 310

Figure 16:
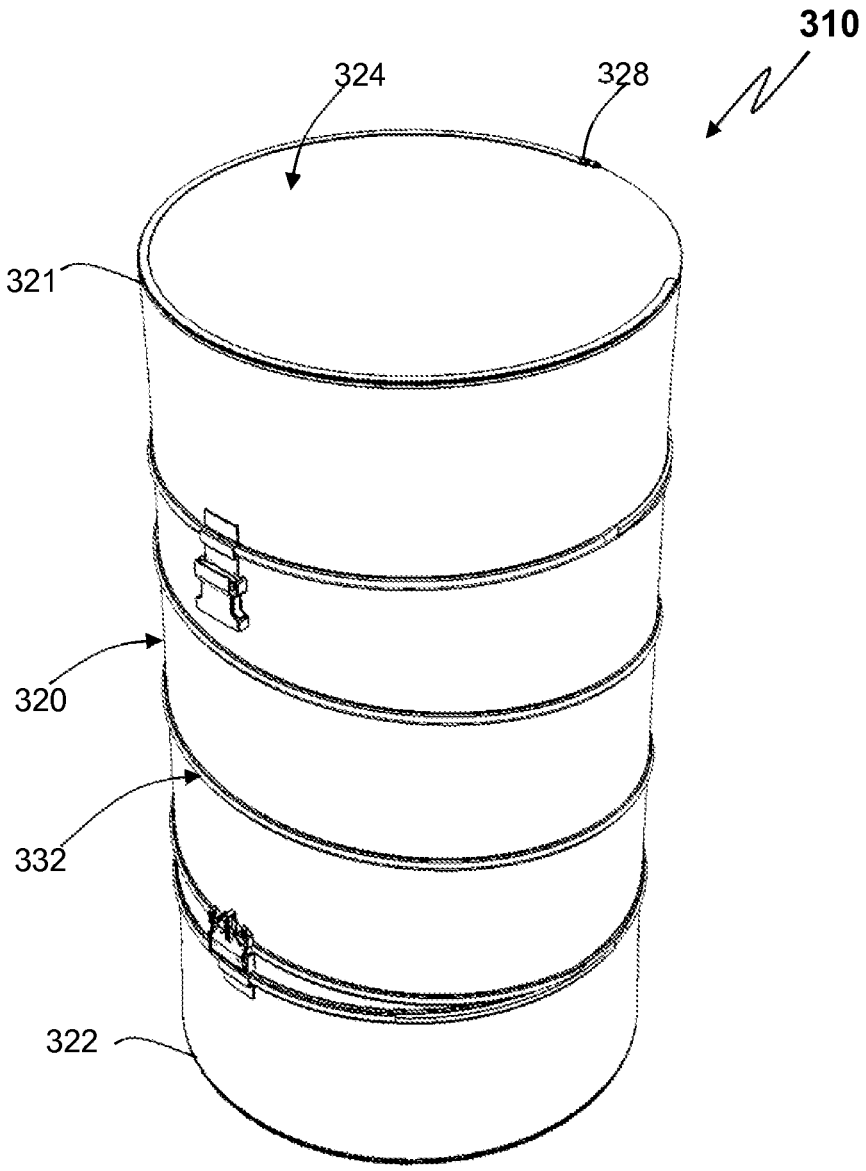
FIG. 16 is a first axial end perspective view of a further alternative embodiment of the dry trim and sift bag apparatus comprising peripheral zipper end-closing devices.
Figure 17:
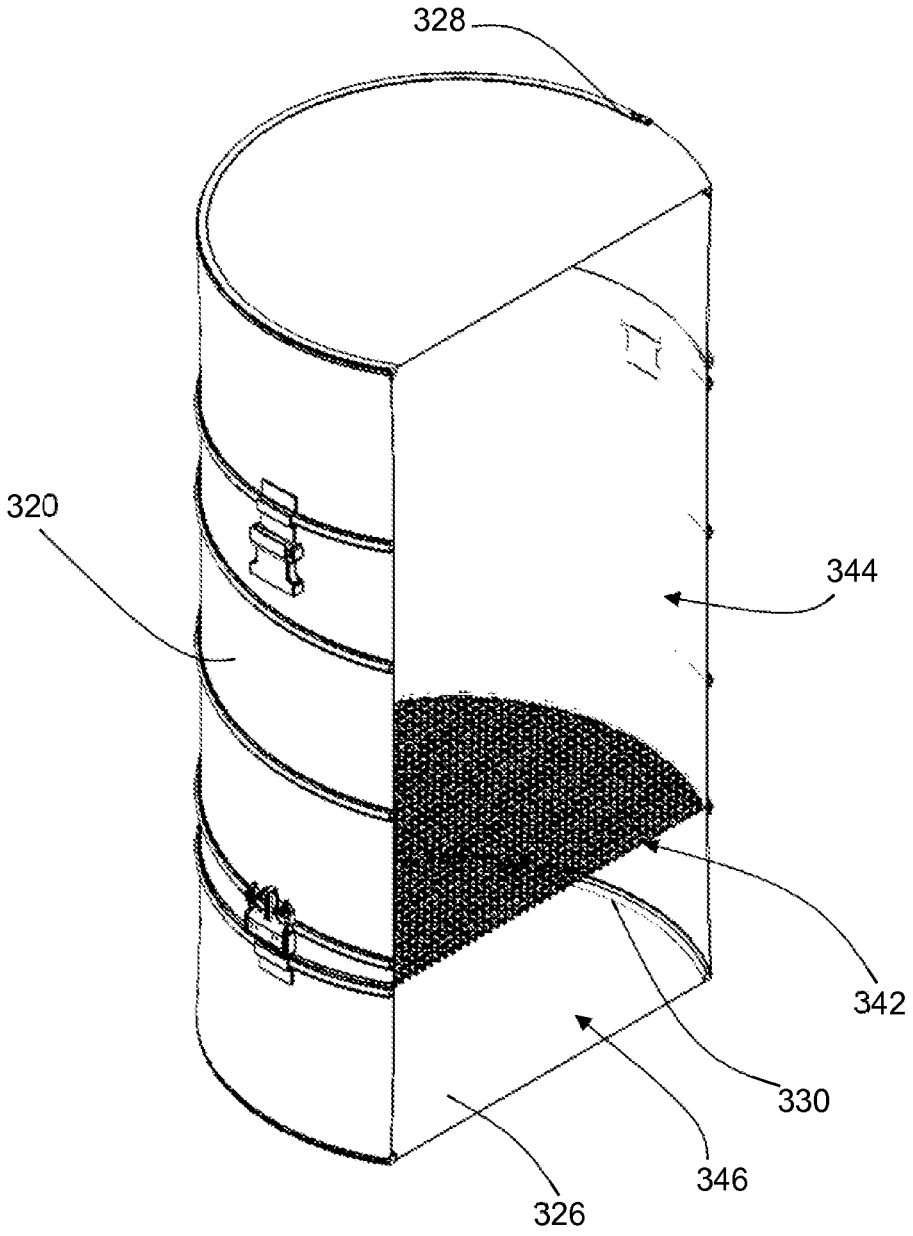
FIG. 17 is a vertical sectional view of the further alternative embodiment of the dry trim and sift bag apparatus illustrated in FIG. 16 having a sieve or screen partition disposed therein.

Referring to FIGS. 16 and 17, reference numeral 310 is directed to a further alternative embodiment of a collapsible multi chamber screen partitioned dry trim and sift bag apparatus.

Analogous to apparatus 10, the collapsible multi chamber screen partitioned dry trim and sift bag apparatus 310 comprises a hollow body 320 having open axial ends 321 and 322.

A pair of selectively openable and closable circular shaped end caps 324 and 326 seal the open axial ends 321 and 322 respectively. End caps 324 and 326 comprise peripheral zipper 328 and peripheral zipper 330 respectively.

Also analogous to apparatus 10, the dry trim and sift bag apparatus 310 comprises a compression coil spring and hem assembly 332 operatively coupled to the hollow body 320 and configured to hold the hollow body 320 in an expanded configuration and to be collapsed under compression to a collapsed configuration.

Furthermore, and analogous to apparatus 10, the dry trim and sift bag apparatus 310 comprises a sifting screen 342 operatively coupled within the hollow body 320 and partitioning the interior of the hollow body 320 into a trim chamber 344 for product to be trimmed and a sift chamber 346 for sifted product, the trim chamber 344 having a greater volume than the sift chamber 346.

Alternate Embodiment 410

Figure 18:
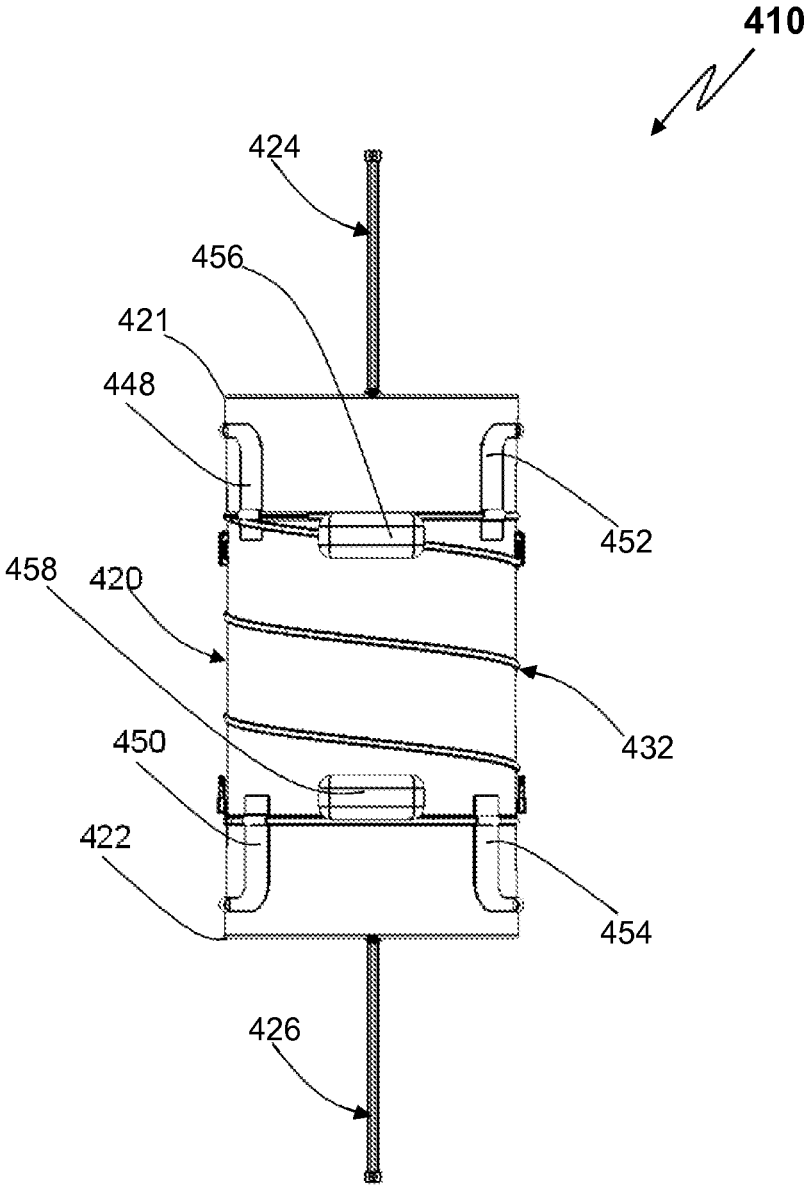
FIG. 18 is a side elevation view of another further alternative embodiment of the dry trim and sift bag apparatus comprising drawstring end-closing devices.
Figure 19:
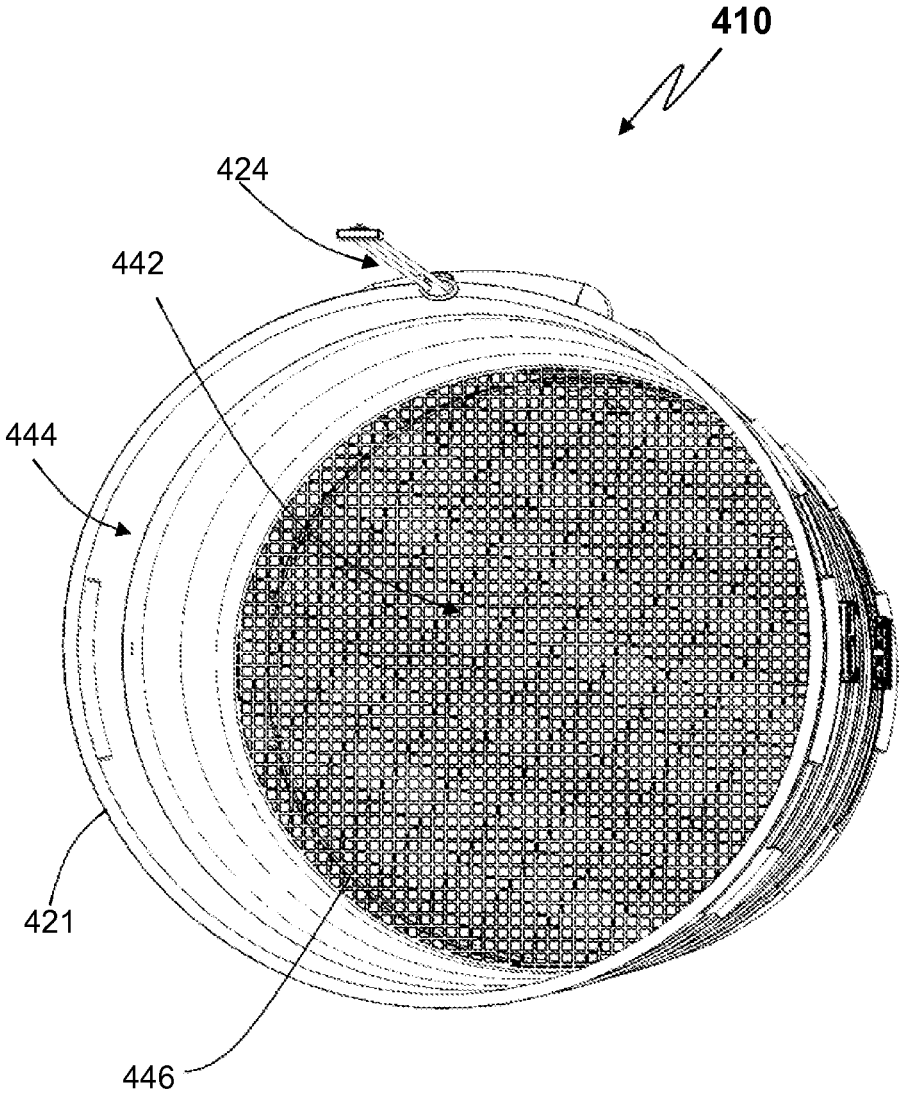
FIG. 19 is a first axial end perspective view of another further alternative embodiment of the dry trim and sift bag apparatus illustrated in FIG. 18 with the drawstring end-closing devices open.

Referring to FIGS. 18 and 19, reference numeral 410 is directed to a further alternative embodiment a collapsible multi chamber screen partitioned dry trim and sift bag apparatus comprising a pair of drawstring end caps 424 and 426.

Analogous to apparatus 10, the collapsible multi chamber screen partitioned dry trim and sift bag apparatus 410 comprises a hollow body 420 having open axial ends 421 and 422 selectively openable and closeable by way of an attached a pair of drawstring end caps 424 and 426 respectively sealing the open axial ends 421 and 422.

Also analogous to apparatus 10, the dry trim and sift bag apparatus 410 comprises a compression coil spring and hem assembly 432 operatively coupled to the hollow body 420 and configured to hold the hollow body 420 in an expanded configuration and to be collapsed under compression to a collapsed configuration.

Furthermore, and analogous to apparatus 10, the dry trim and sift bag apparatus 410 comprises a sifting screen 442 operatively coupled within the hollow body 420 and partitioning the interior of the hollow body into a trim chamber 444 for product to be trimmed and a sift chamber 446 for sifted product, the trim chamber 444 having a greater volume than the sift chamber 446.

Moreover, the dry trim and sift bag apparatus 410 comprises multiple handle assemblies for ergonomic and efficient motion series of operation. In particular, apparatus 410 comprises two pair of axially spaced apart U-shaped strap handles 448, 450 and 452, 454 attached to the outer coil loops of the compression coil spring and hem assembly 432.

In addition, apparatus 410 comprises a pair of axially spaced apart sidewall handles 456 and 458 also attached to the outer coil loops of the compression coil spring and hem assembly 432.

Dry Trim and Sift Bag Storage Case Apparatus 500

Figure 20:
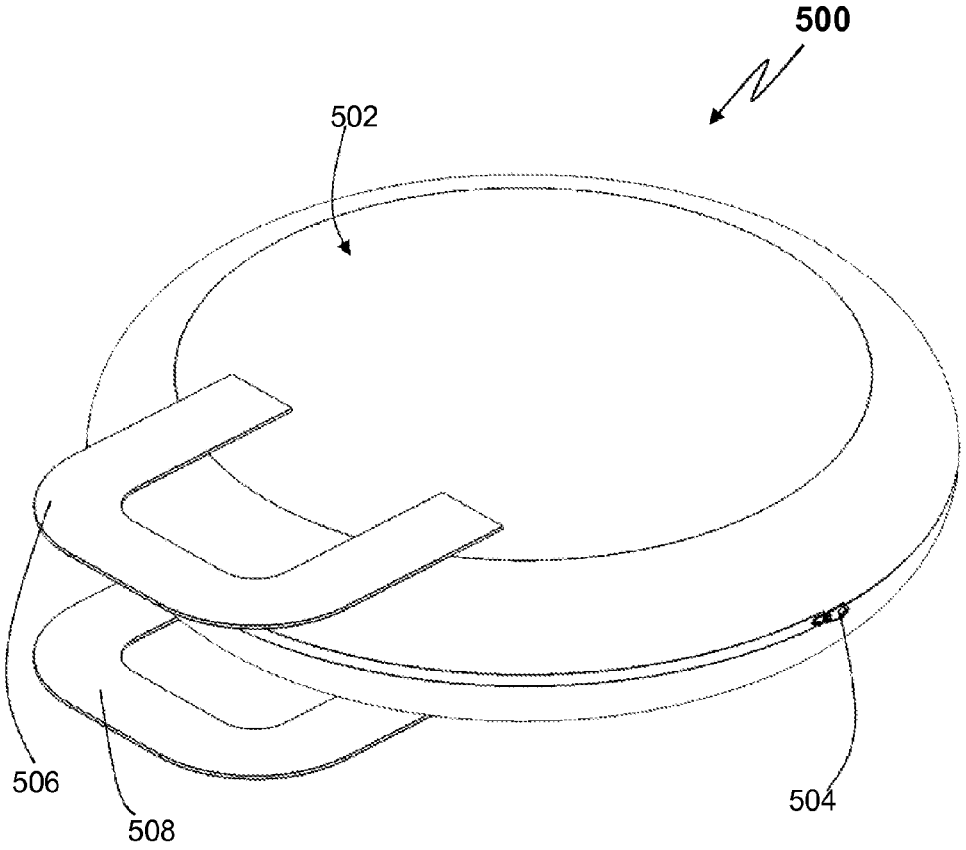
FIG. 20 is a perspective view of an embodiment of a dry trim and sift bag storage case apparatus.

FIG. 20 illustrates is a perspective view of an embodiment of a dry trim and sift bag storage case 500 apparatus having a circular shell body 502 selectively openable and closable by way of an outer peripheral side all zipper 504.

Opposed handles 506, 508 attach by, but not limited, stitching to respective circular sides of circular shell body 502 for carrying ease.

In Use and Operation

In use and operation, the collapsible multi chamber screen partitioned dry trim and sift bag apparatus 10 is utilized by an operator in a multiple motion series method that is both ergonomic and efficient.

Prior to the operator preforming one or more of the motion series methods, the product is initially cut down to desired size and dried to a state that when rubbed between the ones fingers results in the leaf and phyllary of the flowers/buds being flaked off. Once the product is dry, the second axial end cap or collection end cap is closed via second zipper 128. Then the product is loaded into the first end trim chamber 70 that is then closed via first zipper 98. As delineated above, the funnel or cone-like members 84 and 114 are secured to the sidewall 20 using the magnetic snap pairs 140, 142 and 144, 146.

In one embodiment, the operator is preferably in a standing position while performing any one of the motion series methods. The motion series methods generally comprises at least one of the following methods.

Shaking Method

One method comprises transversely shaking an upright vertically positioned apparatus 10, screen end down, generally side to side along transverse or lateral axis 14 utilizing hand pockets 150, 152. In particular, the shaking motion series starts out with the operator in a standing position and having hands in respective hand pockets 150, 152 with the apparatus 10 in a vertical position. Then, transversely shaking the apparatus 10 with loaded product in a side-to-side motion along transverse or lateral axis 14 wherein the side-to-side motion can include an orbit. In general, the shaking motion series is performed in a rhythmic motion forty to fifty times in a minute for about one minute. Motion is done with enough force to move the product in a circular motion, listening/feeling for it to rise and then rolling, tumbling down the inside of the trim chamber 70.

Another shaking method comprises positioning apparatus 10 in a horizontal position and then shaking apparatus 10 from waist to head or shoulder level and back to waist level by holding the first pair of U-shaped strap handles 104, 106 in one hand and the second pair of U-shaped strap handles 134, 136 in the other hand.

Twisting Method

A further method comprises twisting a horizontally positioned apparatus 10 in a clockwise and counter clockwise arc or rotation generally about an axis perpendicular to longitudinal axis 12 or, in other words generally perpendicular to the height of the operator. In one embodiment, the twisting motion series starts out with the operator in a standing position with the first pair of U-shaped strap handles 104, 106 held in one hand and the second pair of U-shaped strap handles 134, 136 held in the other hand with apparatus 10 horizontally disposed. More specifically, each set of U-shaped strap handle pairs 104, 106 and 134, 136 are respectively gripped together in each respective hand to make a handle that meets near the center of each end-cap but is not touching each respective end cap. U-shaped strap handles 104, 106 and 134, 136 are generally tension handles and allow the operator to make a cross-frictional twist motion in the horizontal position. With a controlling grip of the handles, the operator twist apparatus 10 in a clockwise and counter clockwise arc or rotation generally about an axis perpendicular to longitudinal axis 12. In particular, and in one embodiment, the operator horizontally positions apparatus 10 at chest level with elbows lifted out from sides and arms stationary. Then, the operator synchronously twist each wrist back and forth like turning a dial to produce a one-hundred-eighty degree spinning motion of apparatus 10 away from and back to the chest of the operator.

During the twisting motion, the operator preferably listens and/or feels a sweeping motion of the product along the horizontal lower half the interior of sidewall 20 of the trim chamber 70. One cycle of the twisting motion is preferably performed forty to fifty times in one minute.

Bouncing Method

Another further method comprises bouncing an upright vertically positioned, screen end down, apparatus 10 up and down generally along longitudinal axis 12 utilizing hand pockets 150, 152. In one embodiment, the bouncing motion series starts out with the operator in a standing position, the apparatus 10 vertically positioned, and the respective hands of the operator in respective hand pockets 150, 152. Then, bouncing the upright positioned apparatus 10 vertically up and down generally along longitudinal axis 12.

Example Combinations of Motion Series

In one embodiment, the operator is preferably in a standing position and uses a combination of the motion series to trim and shift the product.

For example, the operator can first perform the shaking motion series followed by the bouncing motion series. Then, if necessary, the twisting motion series followed by the bouncing motion series.

In another embodiment, the operator can perform the twisting motion series followed by the bouncing motion series. Then, if necessary, the operator can perform the shaking motion series followed by the bouncing motion series.

In a further embodiment, the operator can perform the shaking motion series then the twisting motion series followed by the bouncing motion series.

In another further embodiment, the operator starts out with the twisting motion series then the shaking motion series followed by the bouncing motion series.

Other orders of motion series including alternating motion series are employed as desired by the operator to obtain the above delineated trim and sift process of operation. As desirable by the operator, each respective motion series can be halted and the product checked for progress.

The multiple handle means make operating the collapsible multi chamber screen partitioned dry trim and sift bag apparatus 10 thru each motion series ergonomic and efficient.

Once the desired motion series is completed to obtain a satisfactory or desired trim, the second axial end cap 110 is preferably partially opened and the sifted product or waste product is funneled out of the collection or sift chamber 72. Then, the first axial end cap 80 is preferably partially opened and the trimmed product is funneled out of the trim chamber 70. Accordingly, apparatus 10 is unloaded and ready for subsequent use.

Trouble Shooting

Each operator/person will have to make slight adjustments to their body movements to obtain the internal motion of the product. Additionally, one of the following variables can be adjusted before repeating the desired motion series for best results.

Check product dryness, if the product is not breaking down it may not be dry enough or if product break down completely it may be overly dry. Correct dryness is important.

Check to see that apparatus 10 is not overloaded precluding product from moving freely. If overloaded, simply remove some of the product and continue with the desired motion series. Remember the product must have room to move around for friction trimming to occur.

Check to see that the product is cut down small enough.

Finally, if the product is not satisfactorily breaking down enough, twist and/or shake apparatus 10 faster or more aggressively.

Friction Trimming

In one aspect, the collapsible multi chamber screen partitioned dry trim and sift bag apparatus 10 provides friction trimming comes from multiple sources during the motion series of operation of the collapsible multi chamber screen partitioned dry trim and sift bag apparatus 10. For example, friction trimming is accomplished by the tumbling, rolling, and swirling of the product against itself and the interior surface of sidewall. When apparatus 10 goes through the twisting motion series with a quick reversal in direction, the product is sent in one direction while the apparatus 10 is moving in the opposite direction thereby creating a cross-frictional trim that quickly removes waste. The shaking and bouncing motions creates friction against the sides and screen. The waste being sifted off also aids in removing unwanted particles. Each of the motion series is designed for speed, efficiency and cleanliness.

Aspects

In one aspect, the collapsible multi chamber screen partitioned dry trim and sift bag apparatus 10 does not require assembly by the operator.

In another aspect, the collapsible multi chamber screen partitioned dry trim and sift bag apparatus 10 is devoid of blades for providing blade-less trimming or friction trimming.

In another aspect, the collapsible multi chamber screen partitioned dry trim and sift bag apparatus 10 does not require electrical power and is powered by the operator allowing for more control of motion to customize the process as needed for different products.

In another aspect, the collapsible multi chamber screen partitioned dry trim and sift bag apparatus 10 does not require electrical power.

In another aspect, the collapsible multi chamber screen partitioned dry trim and sift bag apparatus 10 provides multiple handle systems and is lightweight in design allowing one apparatus to roll, tumble, swirl, shake, bounce, and sift product.

In another aspect, the collapsible multi chamber screen partitioned dry trim and sift bag apparatus 10 accomplishes the trim and sift process in about three to about five minutes wherein the process time is a function of dryness of the product.

In another aspect, the collapsible multi chamber screen partitioned dry trim and sift bag apparatus 10 provides quick pour unloading of the trim product and waste.

In another aspect, the collapsible multi chamber screen partitioned dry trim and sift bag apparatus 10 is reusable within cleaning between loads.

In another aspect, the collapsible multi chamber screen partitioned dry trim and sift bag apparatus 10 collapses for compact and light transport and storage.

In another aspect, the collapsible multi chamber screen partitioned dry trim and sift bag apparatus 10 provides a finished product that retains its natural contours thereby providing a signature of operation that although appears rough, is actually fairly gentile compared to blade style and other types of trimmers.

In another aspect, the collapsible multi chamber screen partitioned dry trim and sift bag apparatus 10 provides multiple friction points for dramatically speeding up the trimming process, so one person can easily accomplish what would take many people to do in the same time.

In another aspect, the collapsible multi chamber screen partitioned dry trim and sift bag apparatus 10 provides a low cost trimmer as compared to blade style and other types of trimmers.

In a further aspect, one particular embodiment of apparatus 10 has, but is not limited to, a height of twenty inches and a diameter of twenty inches when in the expanded state and a height of about three inches with a twenty-inch diameter in the collapsed state.

In a yet further aspect, one particular embodiment of apparatus 10 has, but is not limited to disposing the sieve/screen partition 60 about three inches above the second axial end cap 110 with perforation of one-quarter, three-eighths, or one-half inch in diameter.

The above delineation of apparatus 10, including use, operation, and aspects demonstrates the industrial applicability of this invention.

Moreover, it should be apparent that numerous modifications and adaptations may be resorted to without departing from the scope and fair meaning of this instant invention as set forth hereinabove and as described herein below by the claims.

We claim:

1. A trim and sift bag apparatus, comprising:

a flexible hollow body having open axial ends;

a pair of selectively openable and closable end caps respectively sealing said open axial ends;

a compression spring operatively coupled to said flexible hollow body and configured to hold said flexible hollow body in an expanded configuration and to be collapsed under compression to a collapsed configuration; and a sifting screen operatively coupled within an interior of said flexible hollow body partitioning said interior of said flexible hollow body into a trim chamber for product to be trimmed and a sift chamber for sifted product, said trim chamber having a greater volume than said sift chamber.

2. The apparatus of claim 1 wherein said pair of selectively openable and closable end caps each comprises a selectively openable and closable funnel member.

3. The apparatus of claim 1 wherein said flexible hollow body is formed from about a two-hundred denier to about four-hundred-twenty denier fabric.

4. A trim and sift bag apparatus, comprising:

a circumscribing sidewall formed of a flexible material, said circumscribing sidewall having an exterior surface and an interior surface extending between a first peripheral end of said circumscribing sidewall and a second peripheral end spaced from said first peripheral end along a central longitudinal axis of said circumscribing sidewall, said interior surface defining an interior chamber of said circumscribing sidewall;

a coil spring operatively coupled to said circumscribing sidewall for urging said circumscribing sidewall to an expanded configuration;

a screen disposed within said interior chamber and operatively coupled to said circumscribing bag sidewall at a location more distal from said first peripheral end than said second peripheral end for partitioning said interior chamber into a trim chamber and sifted chamber; said trim chamber having a greater volume than said sifted chamber;

a first selectively openable and closable end cap having an outer periphery operatively coupled to said first peripheral end of said circumscribing sidewall for allow selective access to said trim chamber;

said first selectively openable and closable end cap comprising a funnel portion integrally formed therewith;

a second selectively openable and closable end cap having an outer periphery operatively coupled to said second peripheral end of said circumscribing sidewall for allowing selective access to said sift chamber; and said second selectively openable and closable end cap comprising a funnel portion integrally formed therewith.

5. The apparatus of claim 4 wherein said pair of selectively openable and closable end caps each comprises a selectively openable and closable funnel member.

6. The apparatus of claim 4 wherein said flexible circumscribing sidewall is formed from about a two-hundred denier to about four-hundred-twenty denier fabric.

7. A trim and sift bag apparatus, comprising:

a circumscribing sidewall formed of a flexible material, said circumscribing sidewall having an exterior surface and an interior surface extending between a first open peripheral end of said circumscribing sidewall and a second open peripheral end of said circumscribing sidewall spaced from said first peripheral end along a central longitudinal axis of said circumscribing sidewall wherein said interior surface of said circumscribing sidewall defines an interior chamber;

a coil spring urging said flexible circumscribing sidewall to an expanded configuration;

said coil spring having a first spring loop operatively coupled adjacent to said first peripheral end, a second spring loop operatively coupled adjacent to said second peripheral end, and a spiral wire extending and operatively coupled between said first and said second spring loops;

a screen disposed within said interior chamber and operatively coupled to said circumscribing sidewall at a location more proximate to said second spring loop than said first spring loop for partitioning said interior chamber into a trim chamber and a sift chamber;

said trim chamber having a greater volume than said sift chamber;

a first closable end cap having an outer periphery operatively coupled to said first open peripheral end of said circumscribing sidewall for allowing selective access to said trim chamber;

said first closable cap have a funnel portion integrally formed therewith;

a second closable end cap having an outer periphery operatively coupled to said second open peripheral end of said circumscribing sidewall for allowing selective access to said sifted chamber; and said second closable cap have a funnel portion integrally formed therewith.

* * * * *